US007430963B2

(12) United States Patent
Hennings et al.

(10) Patent No.: US 7,430,963 B2
(45) Date of Patent: Oct. 7, 2008

(54) ENERGETIC MATERIAL INITIATION DEVICE UTILIZING EXPLODING FOIL INITIATED IGNITION SYSTEM WITH SECONDARY EXPLOSIVE MATERIAL

(75) Inventors: George N. Hennings, Ridgecrest, CA (US); Richard K. Reynolds, Calistoga, CA (US); Christopher J. Nance, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 191 days.

(21) Appl. No.: 11/288,371

(22) Filed: Nov. 29, 2005

(65) Prior Publication Data

US 2007/0119325 A1 May 31, 2007

(51) Int. Cl.
*F42C 19/12* (2006.01)
*F42B 3/10* (2006.01)

(52) U.S. Cl. ..... 102/202.5; 102/202.1; 102/202.9; 102/202.14

(58) Field of Classification Search ..... 102/202.5, 102/202.7, 202.14, 202.12, 202.11, 202.9, 102/202.1, 275.11, 202; 280/741
See application file for complete search history.

(56) References Cited

U.S. PATENT DOCUMENTS 3,945,322 A 3/1976 Carlson et al.
4,608,926 A 9/1986 Stevens
4,660,472 A 4/1987 Stevens
4,664,033 A 5/1987 Burkdoll et al.
4,669,400 A 6/1987 Michaels et al.
4,829,765 A 5/1989 Bolieau et al.
5,959,236 A 9/1999 Smith et al.
6,851,370 B2 2/2005 Reynolds et al.
6,923,122 B2 8/2005 Hennings et al.
7,343,859 B2 * 3/2008 Matsuda et al. ..... 102/217

OTHER PUBLICATIONS

Sandia Report SAND97-0582: Through Bulkhead Initiator Studies, David R. Begeal (Mar. 1997).

* cited by examiner

*Primary Examiner*—James S Bergin
(74) *Attorney, Agent, or Firm*—Harness, Dickey & Pierce, P.L.C.

(57) ABSTRACT

An igniter assembly with a housing, an initiator, an input charge, a first barrier, a second barrier, and an output charge. The input charge is formed of a secondary explosive and disposed adjacent the initiator. The first barrier cooperates with the housing to form a chamber into which the input charge is received. The second barrier is disposed on a side of the first barrier opposite the input charge and combusts in response to energy released during detonation of the input charge. The output charge is formed of a pyrotechnic material and disposed on a side of the second barrier opposite the first barrier. The output charge can combust in response to energy released during combustion of the second barrier. The housing and the first barrier cooperate to isolate the output charge from heat and pressure generated by the input charge if the input charge is cooked-off.

24 Claims, 9 Drawing Sheets

ENERGETIC MATERIAL INITIATION DEVICE UTILIZING EXPLODING FOIL INITIATED IGNITION SYSTEM WITH SECONDARY EXPLOSIVE MATERIAL

INTRODUCTION

The present invention generally relates to energetic material initiation devices and more particularly to an energetic material initiation device that when activated can produce a deflagration output having a high pressure, high temperature impulse and that when inactivated can absorb a relatively high voltage and current electrical input without ejecting matter from the output end of the initiation device.

Devices, such as rocket motors, employ initiators for producing a pyrotechnic output for initiating combustion. Known initiators are typically activated via a relatively low energy electric impulse and thus maintained out of alignment with the device until activation of the initiator is desired. Mechanisms that move an initiator between an out-of-alignment position and an in-line position are generally disadvantageous due to considerations for cost, weight and reliability. Additionally, the known initiators typically produce output pressures of about 200 to about 1000 p.s.i.g with a rise time of about 5 to about 20 milliseconds. In applications where the initiator is threaded into a bulkhead, the electrical inputs to the initiator must remain sealed to prevent hot gases (e.g., from the firing rocket motor) from venting through the initiator. Typical post firing requirements range from sealing pressures of about 5,000 to about 10,000 p.s.i.g. and temperatures ranging from about 300 to about 1,000° F.

An initiator constructed in accordance with the teachings of U.S. Pat. No. 6,923,122 (Energetic Material Initiation Device Utilizing Exploding Foil Initiated Ignition System With Secondary Explosive Material) having an integrated planar switch constructed in accordance with the teachings of U.S. Pat. No. 6,851,370 (Integrated Planar Switch For A Munition) could be safely employed as an in-line initiator, but not all governmental agencies approve of the use of switches in the initiator.

Accordingly, there remains a need in the art for an initiator that may be employed in an in-line arrangement with a device such as a rocket motor.

SUMMARY

In one form, the present teachings provide an igniter assembly that includes a housing, an initiator, an input charge, a first barrier, a second barrier, and an output charge. The input charge can be formed of a secondary explosive and can be disposed adjacent the initiator. The first barrier can cooperate with the housing to form a chamber into which the input charge is received. The second barrier can be disposed on a side of the first barrier opposite the input charge and can combust in response to energy released during detonation of the input charge. The output charge can be formed of a pyrotechnic material and can be disposed on a side of the second barrier opposite the first barrier. The output charge can combust in response to energy released during combustion of the second barrier. The housing and the first barrier cooperate to form a structure that isolates the output charge from heat and pressure generated by the input charge if the input charge is cooked-off so that the output charge is not sympathetically cooked-off or initiated.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
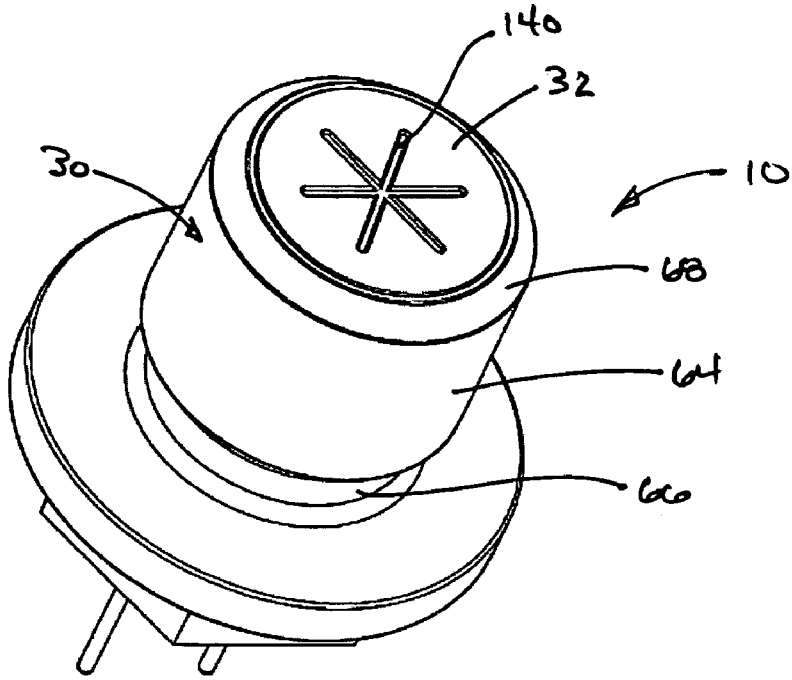
FIG. 1 is a perspective view of an energetic material initiation device constructed in accordance with the teachings of the present disclosure.
Figure 2:
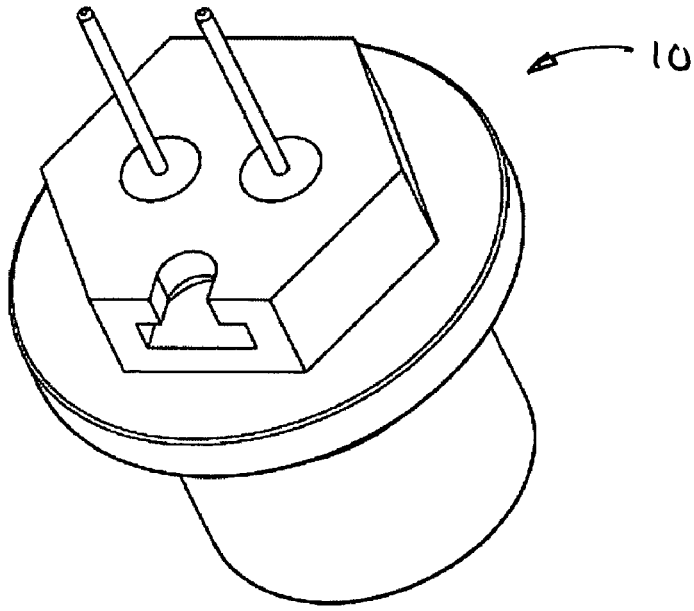
FIG. 2 is perspective view of a bottom side of the energetic material initiation device of FIG. 1.

With reference to FIGS. 1 through 4 of the drawings, an energetic material initiation device constructed in accordance with the teachings of the present disclosure is generally indicated by reference numeral 10. The energetic material initiation device 10 can include a housing assembly 12, an initiator assembly 14, an input charge 16, a sleeve 18, a first barrier structure 20, a second barrier structure 22 and an output charge 24. In the particular example provided, the housing assembly 12 includes a base assembly 30 and a cover 32.

Figure 3:
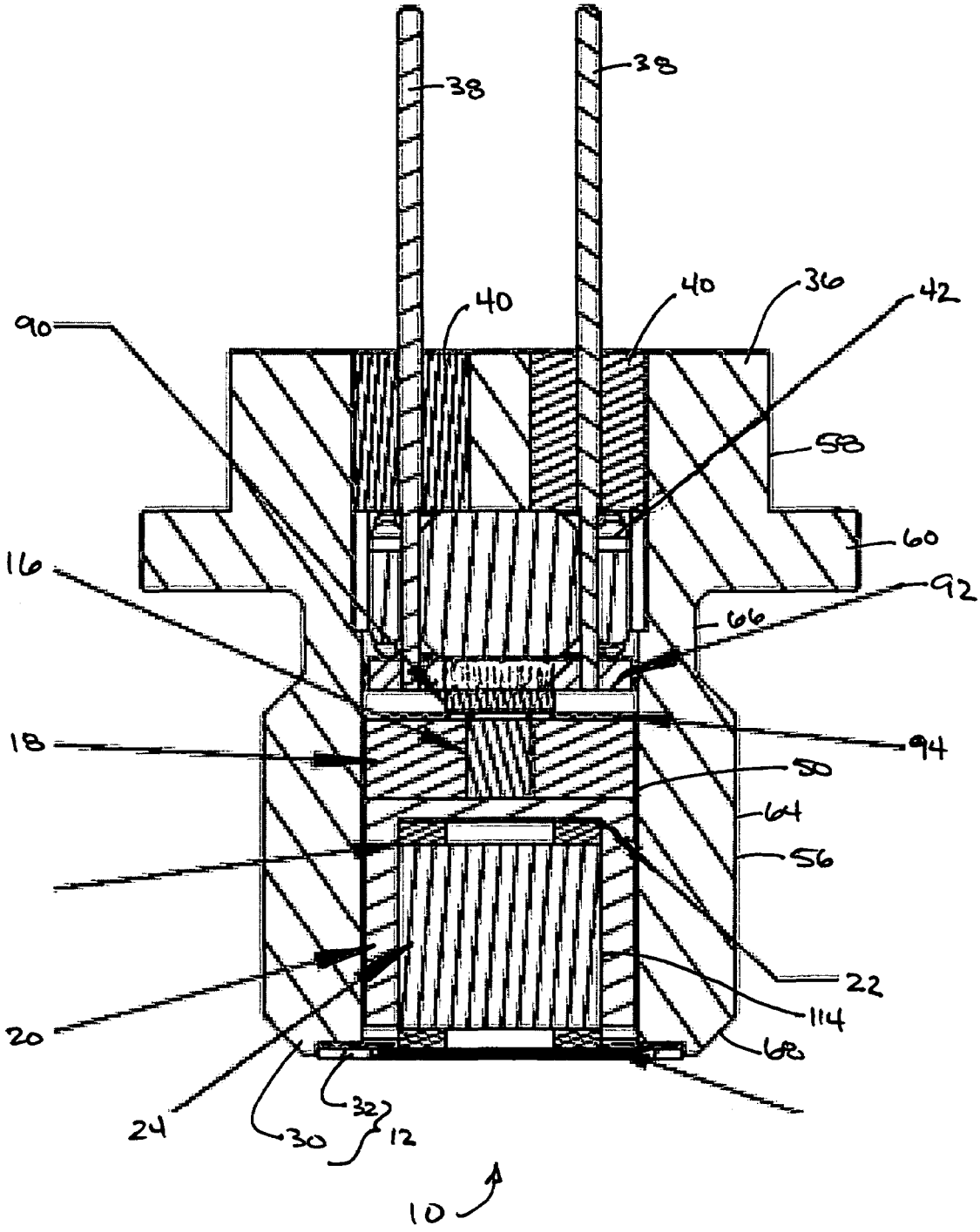
FIG. 3 is a longitudinal section view of the energetic material initiation device of FIG. 1.
Figure 4:
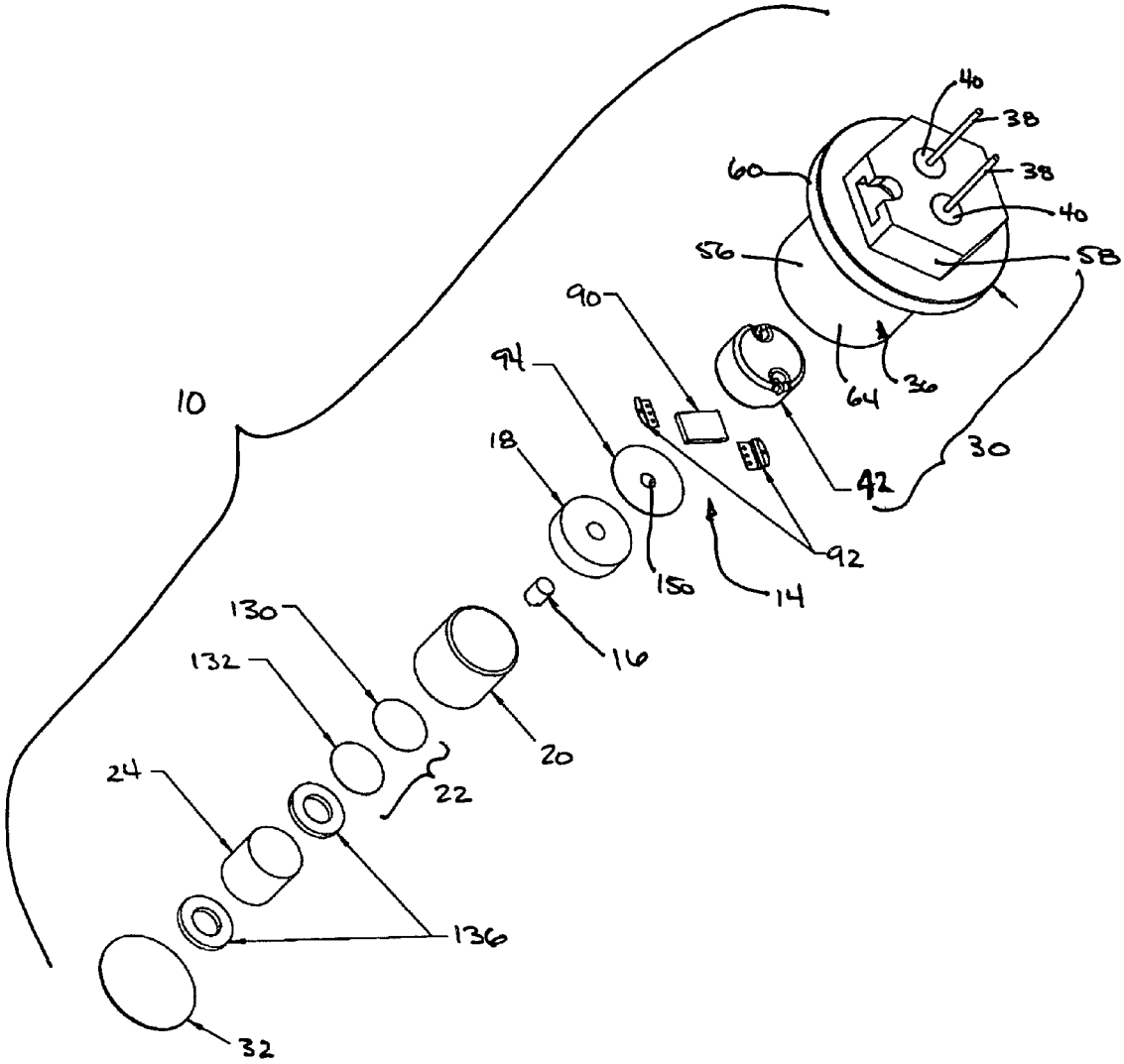
FIG. 4 is an exploded perspective view of the energetic material initiation device of FIG. 1.
Figure 5:
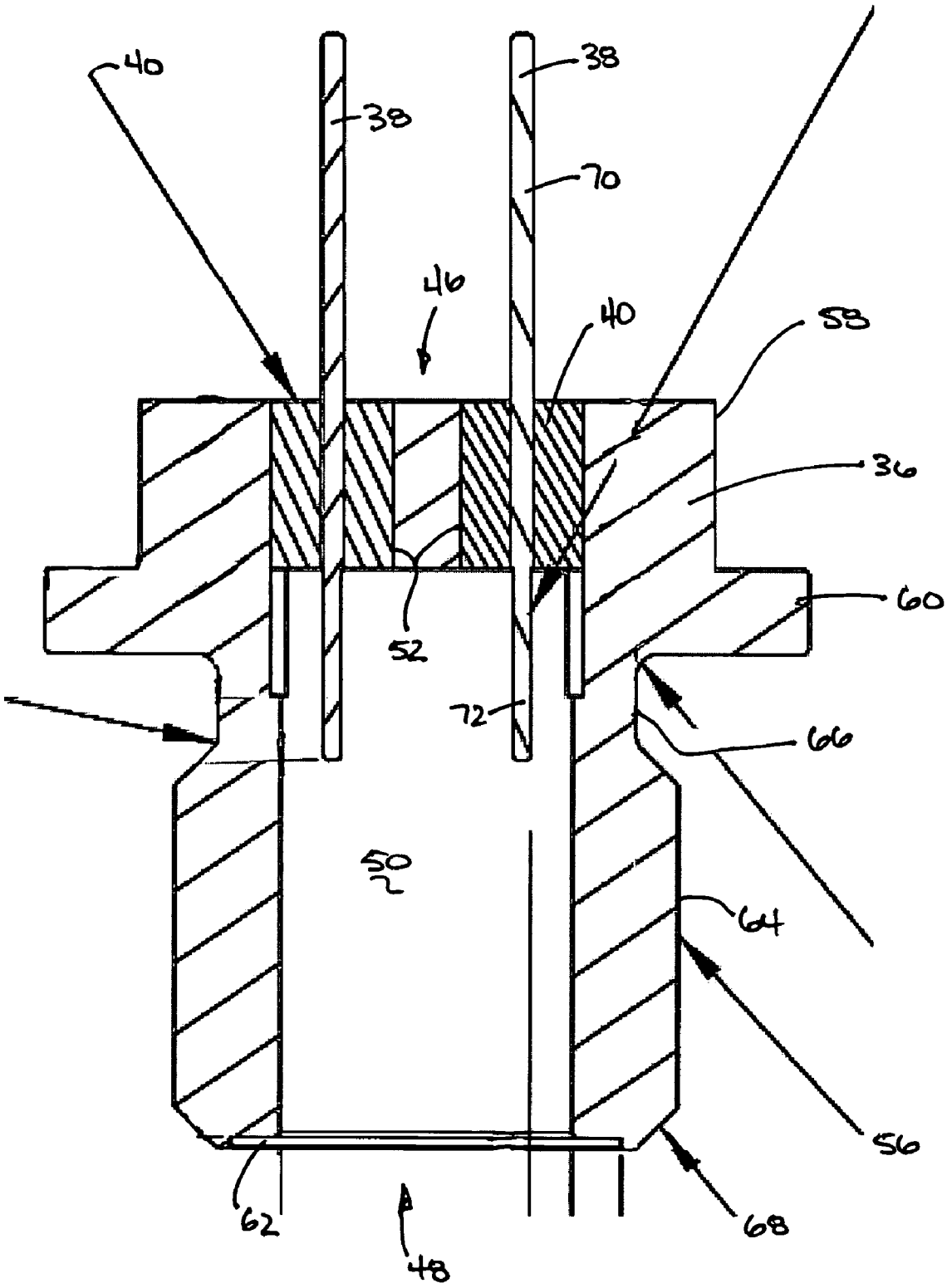
FIG. 5 is a longitudinal section view of a portion of the energetic material initiation device illustrating a portion of the housing assembly in more detail.
Figure 6:
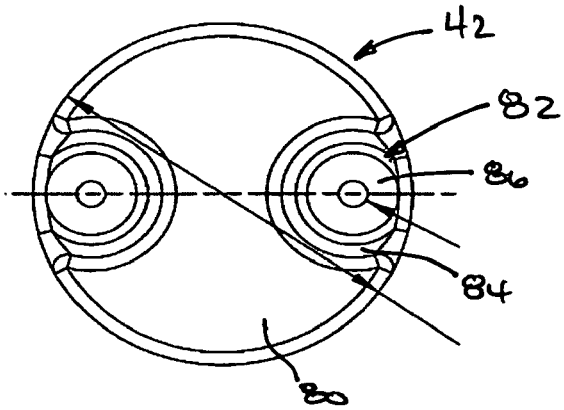
FIG. 6 is a bottom view of a portion of the housing assembly illustrating the spacing member in more detail.
Figure 7:
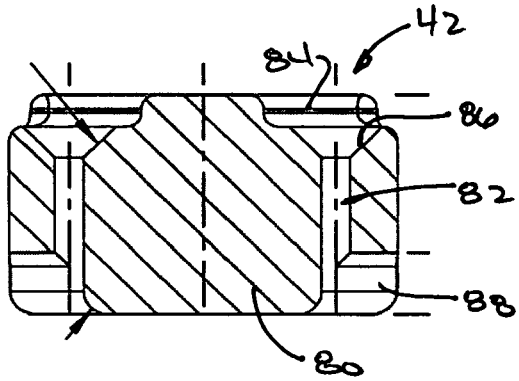
FIG. 7 is a longitudinal section view of the spacing member of FIG. 6.
Figure 8:
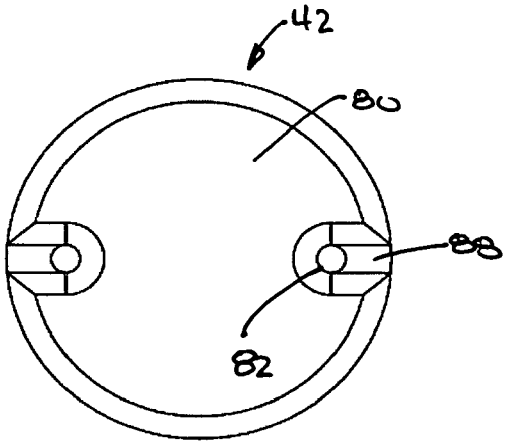
FIG. 8 is a top view of the spacing member.

With reference to FIGS. 3 through 5, the base assembly 30 can include a housing 36, a plurality of electric contacts 38, a plurality of seal members 40 and a spacing member 42. The housing 36 can be formed of any suitable material, such as 304 stainless, and can have an input end 46, an output end 48, an internal cavity 50, and a plurality of seal apertures 52. The internal cavity 50 can be formed through the output end 48 and can terminate forwardly of the input end 46. The seal apertures 52 can be formed through the input end 46 and can intersect the internal cavity 50. In the particular example provided, the housing 36 further includes a threaded portion 56, a drive portion 58, a flange member 60, which is disposed between the threaded portion 56 and the drive portion 58, and a recess 62.

The threaded portion 56 can have an appropriately sized male thread segment 64, such as a 7/16-20 threaded male segment, a necked-down portion 66 and a thread relief portion 68. The necked-down portion 66 can permit the threaded portion 56 to be threadably inserted into a mating female threaded device, such as the bulkhead (not shown) of a rocket motor (not shown) to a depth in which the flange member 60 contacts the device.

The thread relief portion 68 can be configured to reduce or prevent damage to the threads of the threaded portion 56 when the energetic material initiation device 10 is assembled. In the particular example provided, the thread relief portion 68 includes a 0.020 inch minimum chamfer formed about the output end 48.

The drive portion 58 can be configured in any appropriate manner to provide a means by which torque can be applied to the energetic material initiation device 10 when threadably coupled the threaded portion 56 to a device (not shown). The drive portion 58 can include, for example, an outer surface of the input end 46 having a non-circular cross-sectional shape. In the example provided, the drive portion 58 has a hex-shaped cross-sectional shape.

The recess 62 can be configured to at least partially receive the cover 32. In the example provided, the recess 62 is a counterbore that is formed into the output end 48 of the housing 36.

The electric contacts 38 can be formed of an appropriate material, such as an iron-nickel alloy conforming to SAE-AMS-I-23011 Class II having a layer of electrolytic nickel plating and an outer layer of gold plating. The electric contacts 38 can have a first portion 70 of a first diameter, such as 0.020 inch, and a second portion 72 of a second, smaller diameter, which can be about 40% to about 95% of the first diameter and more preferably about 55% to about 90% of the first diameter.

The seal members 40 can be formed of an appropriate material, such as a glass conforming to 2304 Natural or other dielectric material and can be positioned relative to the housing 36 so as not to extend into the internal cavity 50 (i.e., the seal members 40 can be flush or below the portion of the housing 36 that defines the bottom of the internal cavity 50). Each seal member 40 can be disposed in a respective one of the seal apertures 52 and can form a seal between the housing 36 and a respective one of the electric contacts 38. The seal created by each seal member 40 can be configured to withstand a predetermined pressure, such as 5,000 p.s.i.g. for a predetermined amount of time, such as one minute, without permanent deformation or structural failure, and/or can be configured to leak at a rate that does not exceed a predetermined rate, such as $1\times10^{-6}$ cc per second at one atmosphere of gage pressure. The electric contacts 38 can be positioned relative to respective seal members 40 such that the smaller diameter second portion 72 of the electric contacts 38 extends into the internal cavity 50.

With reference to FIGS. 3 and 6 through 8, the spacing member 42 can be formed of a suitable dielectric, such as polycarbonate, and can include a body 80 that is sized to be received into the internal cavity 50. The body 80 can define a pair of contact apertures 82 through which the electric contacts 38 can be received. The contact apertures 82 can be formed with a counterbore 84 and countersink 86 on a first side of the body 80 and a groove 88 on a second side of the body 80. Each counterbore 84 can be configured to define a chamber that is located about an associated one of the electric contacts 38 when the spacing member is fully inserted into the internal cavity 50, while the countersink 86 can help to align the spacing member 42 to a respective one of the electric contacts 38. The grooves 88 can extend radially outwardly and can be sized to receive the second portion 72 (FIG. 5) of an associated one of the electric contacts 38.

Figure 9:
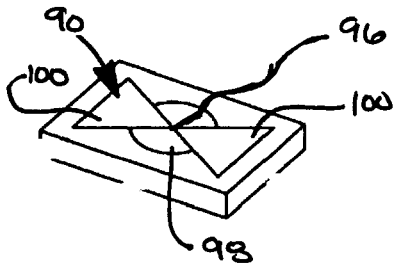
FIG. 9 is a perspective view of a portion of the energetic material initiation device illustrating the exploding foil initiator in more detail.

In FIGS. 3, 4 and 9, the initiator assembly 14 can include an exploding foil initiator 90, a pair of electric terminals 92 and a barrel 94. It will be appreciated that the exploding foil initiator 90 includes a bridge 96 and a flyer 98. It will also be appreciated that while the barrel 94 is illustrated as a discrete component, the initiator assembly 14 could be constructed such that the barrel 94 is unitarily formed (e.g., permanently coupled) to the exploding foil initiator 90. Additional details and background on exploding foil initiators can be found in U.S. Pat. No. 6,851,370 entitled "Integrated Planar Switch For A Munition", the disclosure of which is hereby incorporated by reference in its entirety as if fully set forth in detail herein. Each electric terminal 92 can be electrically coupled to an associated one of the electric contacts 38 and to a corresponding terminal 100 on the exploding foil initiator 90 to provide a means by which electrical energy may be applied to the bridge 96.

The input charge 16 can be a secondary explosive, such as RSI-007, which is available from Reynolds Systems, Inc. of Middletown, Calif. In the particular example provided, the material that forms the input charge 16 is RSI-007, which is available from Reynolds Systems, Inc. of Middletown, Calif. The RSI-007 material is described in detail in co-pending U.S. patent application Ser. No. 09/990,095 filed Nov. 20, 2001 and Ser. No. 10/002,894 filed Dec. 5, 2001 (U.S. Patent Application Publication 20020079030), both of which being entitled "Low Energy Initiated Explosive", the disclosures of which are hereby incorporated by reference. Those skilled in the art will appreciate, however, that the input charge 16 may be made of any material that may be detonated by an exploding foil initiator, including explosives such as HNS-IV, HNS-I, PETN, NONA and CL-20 FPS. The mass of the input charge 16 can be less than or equal to about 20 mg. Preferably, the mass of the input charge 16 is less than or equal to about 15 mg and more preferably less than or equal to about 8 mg.

The sleeve 18 can be formed of an appropriate material, such as aluminum, and is configured to support the input charge 16 within the internal cavity 50.

Figure 10:
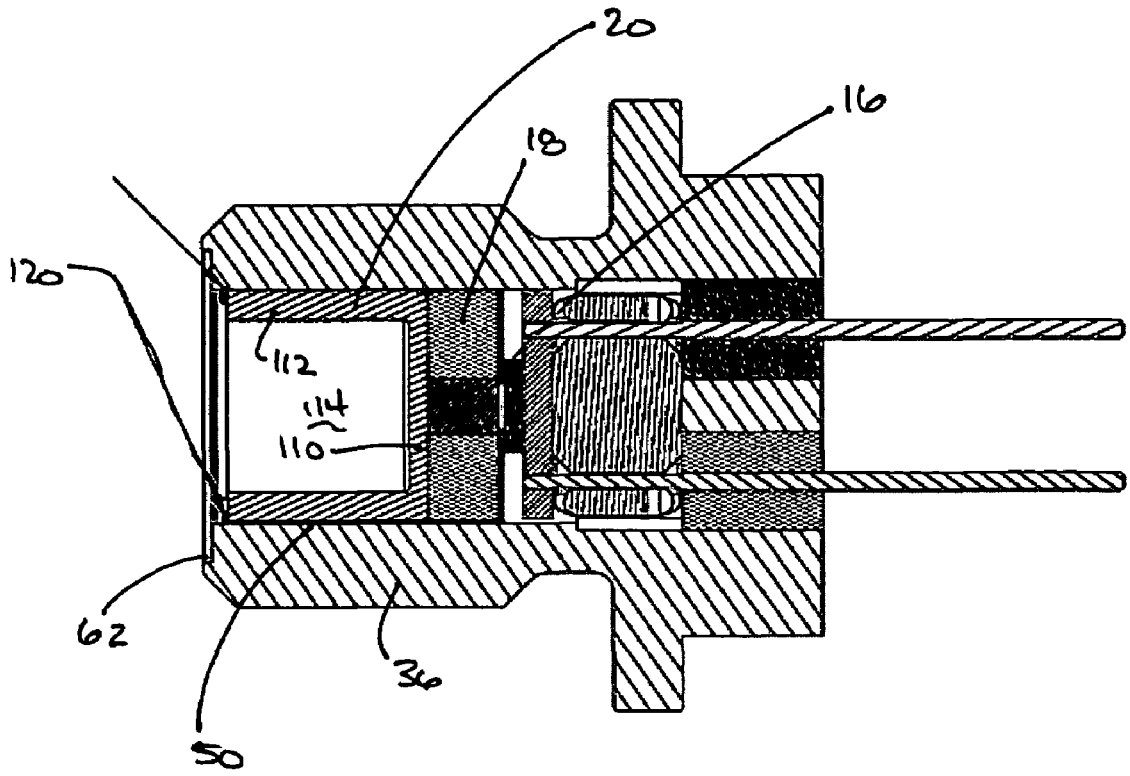
FIG. 10 is a longitudinal section view of a portion of the energetic material initiation device that illustrates the first barrier structure in more detail.

With reference to FIG. 10, the first barrier structure 20 can be a cup-shaped structure having a bottom wall 110 and an annular side wall 112 that cooperate to form a cavity 114. The thickness of the bottom wall 110 can vary depending on several design factors, including the material and size of the input charge 16 and the material and size of the output charge 24 (FIG. 3). In the particular example provided, the bottom wall 110 can have a thickness of about 0.020 inch to about 0.080 inch and preferably about 0.040 inch to about 0.060 inch. The first barrier structure 20 can be formed of a material such as 304 stainless and can be received into the internal cavity 50 such that the annular side wall 112 abuts abut the input charge 16 and the sleeve 18. The annular side wall 112 can extend upwardly in the internal cavity 50 and can terminate rearwardly of the recess 62 in the housing 36. A weld 120, for example, can be formed about the perimeter of the annular side wall 112 to fixedly and sealingly couple the first barrier structure 20 to the housing 36. It will be appreciated that the weld 120 or other coupling/sealing means can form a hermetic seal between the input charge 16 and the output charge 24 (FIG. 3). In the particular example provided, the weld 120 is formed via laser welding.

With renewed reference to FIGS. 3 and 4, the second barrier structure 22 can be received in the cavity 114 and disposed between the first barrier structure 20 and the output charge 24. The second barrier structure 22 can at least partially burn in response to the high heat and pressure of the detonating input charge 16 to thereby ignite the output charge 24. In the example illustrated, the second barrier structure 22 is a composite that includes a reactable member 130, which can be formed from a metal such as titanium or another suitably reactive material that is inert under normal circumstances, and an oxidizer member 132, which can be formed from a material such as Teflon® (i.e., polytetrafluoroethylene). In the particular example provided, the reactable member 130 is formed of titanium and has a thickness of about 0.001 inch, while the oxidizer member 132 is formed of Teflon® and has a thickness of about 0.001 inch.

The output charge 24 can be formed from a suitable material, such as a material that may be used for initiating ignition or deflagration in a pyrotechnic material. In the example provided, the output charge 24 is formed from boron potassium nitrate ($BKNO_3$) and can be disposed within the cavity 114 in the first barrier structure 20. Optionally, a resilient member 136, such as a silicone rubber washer, can be disposed between the second barrier structure 22 and the output charge 24 and/or between the output charge 24 and the cover 32.

With reference to FIGS. 1, 3 and 4, the cover 32 can be formed of any appropriate material and can be received into the recess 62 (FIG. 5) in the housing 36. The cover 32 can be sealingly secured to the housing 36 through any appropriate means, such as welding (e.g., laser welding). The cover 32 can include one or more stress risers 140 that can render one or more areas of the cover 32 more susceptible to rupturing upon ignition of the output charge 24. In the example provided, the stress riser 140 is formed by a plurality of intersecting grooves that can cooperate to define a plurality of petals or folds that deploy outwardly when the cover 32 ruptures. As those skilled in the art will appreciate the stress riser 140 may be formed in any appropriate manner and/or configuration and as such, the embodiment provided herein is merely exemplary. For example, perforations or non-continuous grooves may be substituted for one or more of the illustrated grooves, or the thickness of the cover 32 may be reduced in one or more areas to form the stress riser 140. Furthermore, those of ordinary skill in the art will appreciate that the configuration of the stress riser 140 need not provide folds, but rather could form any predefined shape, such as one or more hinged tabs. Alternatively, the stress riser 140 may be configured to form a shape that is not predetermined (i.e., randomly rupture in a predetermined area), as when the area of the rupture is machined or formed relatively thinner than the surrounding area of the cover 32 so that the area of the rupture is predetermined but the shape of the rupture is not.

With renewed reference to FIGS. 1, 3 and 4, when the energetic material initiation device 10 is to be activated, a high current pulse, typically in excess of 1000 amps, is passed through the bridge 96 (FIG. 9) of the exploding foil initiator 90, causing the bridge 96 (FIG. 9) to vaporize and form a plasma. The hot, high pressure plasma propels the flyer 98 (FIG. 9) at a relatively high velocity through a hole 150 in the barrel 94 where it impacts the input charge 16 and causes the input charge 16 to detonate. Preferably, the input charge 16 is formed of a material, such as RSI-007, that permits a shock wave having full detonation velocity to develop despite the relatively small size of the input charge 16. Detonation of the input charge 16 can cause the smaller second portion 72 (FIG. 5) of the electric contacts 38 to buckle.

The first barrier structure 20 attenuates the shock wave that is produced during detonation of the input charge 16. In the particular example provided, the first barrier structure 20 is not configured to rupture as a result of the detonation of the input charge 16, but those of ordinary skill in the art will appreciate that the first barrier structure 20 could be configured to rupture in response to detonation of the input charge 16. Energy that is transmitted through the first barrier structure 20 is employed to initiate a reaction of the second barrier structure 22 wherein the second barrier structure 22 ignites and/or burns. Stated another way, at least a portion of the second barrier structure 22 participates in a chemical reaction in which the second barrier structure 22, in whole or in part, to oxidizes and burns to ignite the output charge 24.

Ignition of the output charge 24 generates heat and pressure within the confined space of the housing assembly 12 that can cause the cover to rupture (e.g., in the area of the stress riser 140 (FIG. 1)) and produce an output kernel or pyrotechnic output that is capable of igniting an adjacent pyrotechnic material (not shown), such as the fuel of a rocket motor (not shown). Significantly, the seal members 40 are configured to maintain the integrity of the seal between the housing 36 and the associated electric contact 38 when the energetic material initiation device 10 is activated.

It will be appreciated that the energetic material initiation device 10 can be configured to provide an output pressure pulse having a desired shape (pressure versus time). This feature permits the energetic material initiation device 10 to be tailored to a specific application so that the energetic material initiation device 10 can be directly substituted for a prior art initiator without changing the volume or operational characteristics (with the exception of the electrical firing characteristics) of the initiator. Accordingly, the energetic material initiation device 10 can provide a drop-in replacement for a prior art initiator and can eliminate the requirement to maintain the initiator in an out-of-alignment condition.

If the energetic material initiation device 10 is subjected to an electrical impulse having a predetermined amount of energy that is below that which is required to activate the energetic material initiation device 10, such as a 440 volt, 20 amp electrical impulse as specified in Military Standard MIL-DTL-23659, Appendix B (General Design Specification for Electric Initiators), the energetic material initiation device 10 will not activate (i.e., will remain in an inactivated state). Moreover, the predetermined amount of energy associated with the non-activating electrical impulse is sufficient to cause the input charge 16 to "cook-off" (i.e., vaporize or combust in response to heat generated by the electrical impulse) but does not cause the energetic material initiation device 10 to either activate or to discharge matter from the output end 48.

In this regard, the heat generated through the "cooking off" of the input charge 16 (i.e., heat generated by the application of the non-activating electrical impulse to the energetic material initiation device 10 and/or by the vaporization or combustion of the input charge 16) can vaporize one or more of the electric contacts 38 and/or push one or more of the electric contacts 38 rearwardly so as to degrade the seal that is formed between an electrical contact 38 and an associated seal member 40 to thereby provide a vent path through which gases can be vented through the rear of the housing assembly 12.

It will be appreciated that pressure developed when the input charge 16 is "cooked-off" will be at least temporarily contained in a structure that is formed by the first barrier structure 20 and the housing assembly 12. The spacing member 42 can be configured with a degree of resiliency to compress/deflect in response to elevated pressure within the internal cavity 50. Moreover, as the internal cavity 50 could be purged of gases when the first barrier structure 20 is hermetically sealed to the housing 36, the counterbores 84 (FIG. 6) or other features in the spacing member 42 can be configured to act as a reservoir where some of the gases generated during the "cooking off" of the input charge 16 can be stored. Additionally, the grooves 88 (FIG. 8) in the spacing member 42 can permit one or more of the electric contacts 38 to deflect therein in response to the heat and pressure associated with the "cooking off" of the input charge 16 to electrically decouple the electric contact 38 from an associated one of the electric terminals 92.

Significantly, the first barrier structure 20 and the housing assembly 12 are configured to isolate the output charge 24 from the heat and pressure generated by the input charge 16 if the input charge 16 is "cooked-off". This isolation is significant in that it prevents the output charge 24 from being sympathetically "cooked-off" or initiated. The resilient member or members 136, if employed, can further aid in thermally isolating the output charge 24 from heat generated when the input charge 16 is "cooked-off".

Figure 11:
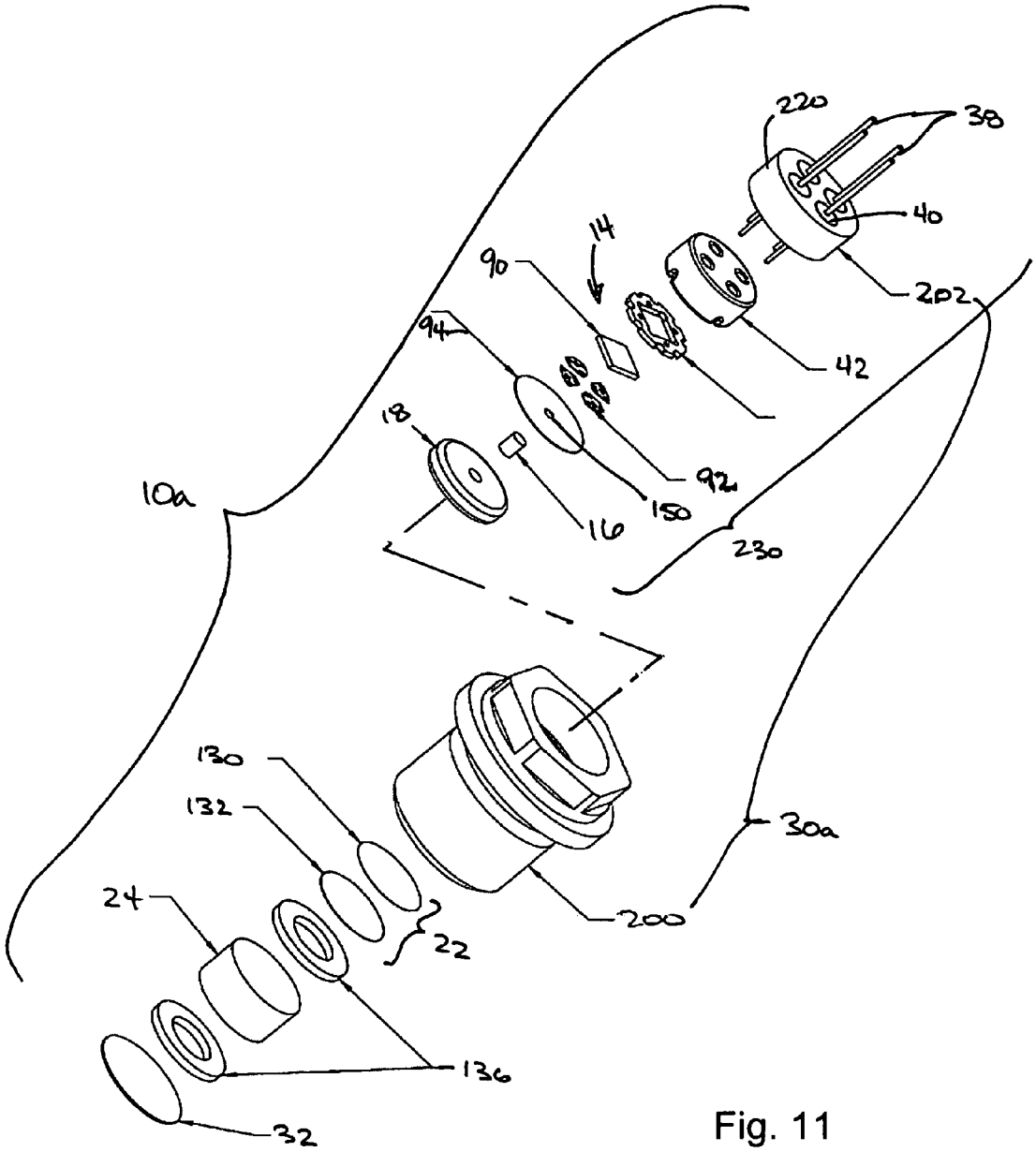
FIG. 11 is an exploded perspective view of another energetic material initiation device constructed in accordance with the teachings of the present disclosure.
Figure 12:
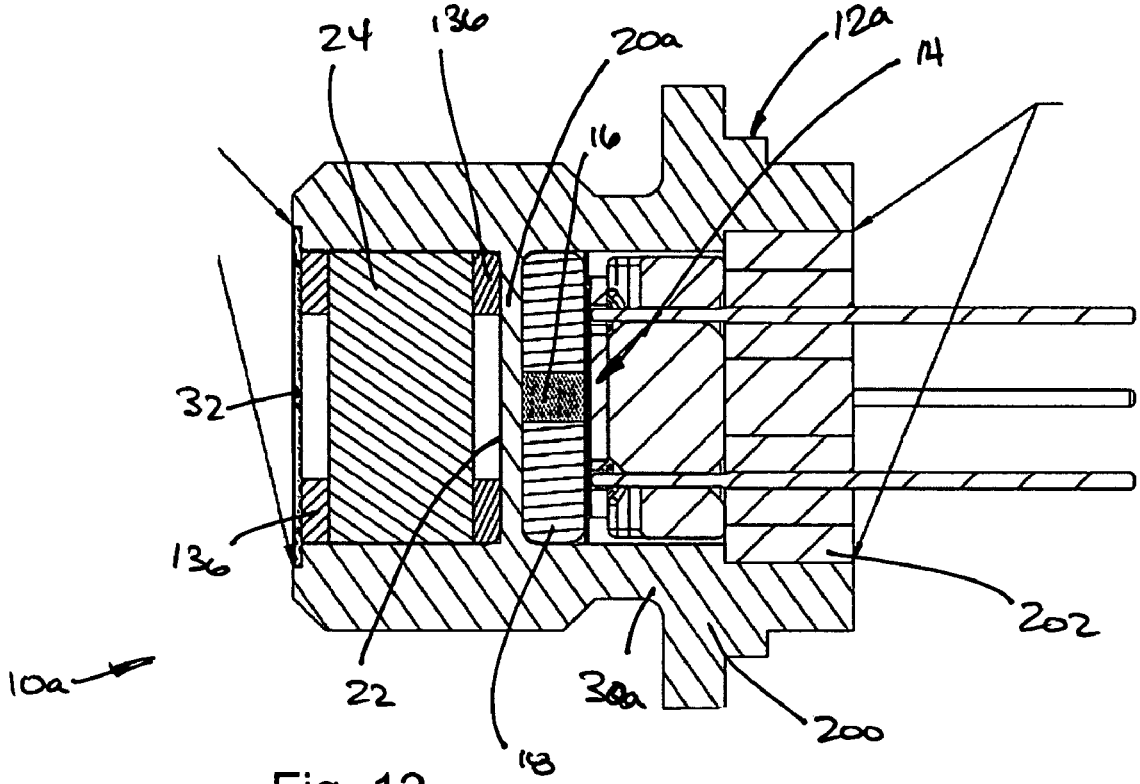
FIG. 12 is a longitudinal section view of the energetic material initiation device of FIG. 11.
Figure 13:
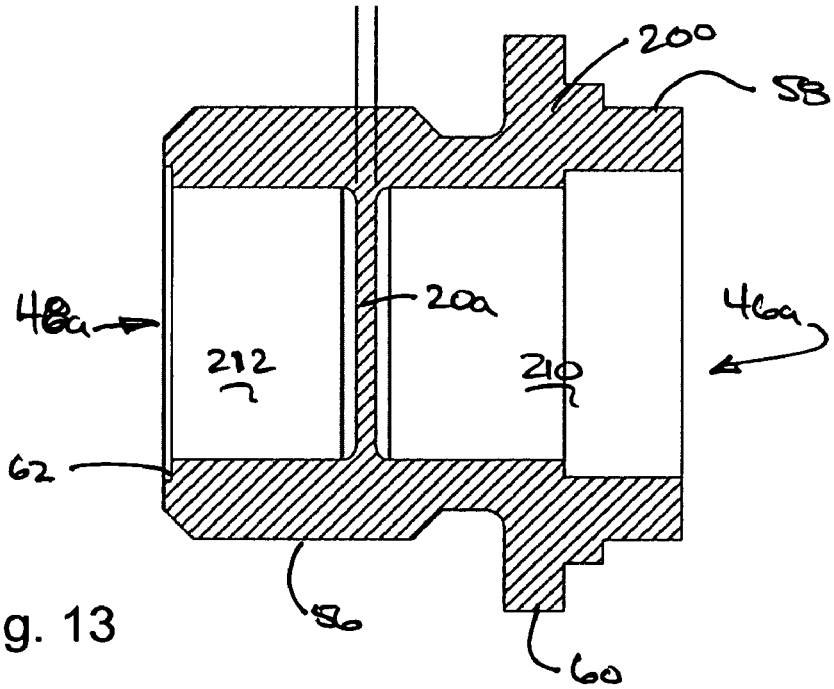
FIG. 13 is a longitudinal section view of a portion of the energetic material initiation device of FIG. 11 illustrating the construction of the housing assembly in more detail.

While the energetic material initiation device 10 has been illustrated and described thus far as including a discrete first barrier structure 20 that is disposed between the input charge 16 and the output charge 24, those of ordinary skill in the art will appreciate that the scope of the present disclosure is not so limited. In this regard, another energetic material initiation device 10*a* constructed in accordance with the teachings of present disclosure is illustrated in FIGS. 11 through 13. It should be understood that throughout the drawings, corresponding reference numerals indicate like or corresponding parts and features. Accordingly, it will be appreciated that the various parts and features that are common to both the energetic material initiation device 10 (FIG. 1) and the energetic material initiation device 10*a* are described in detail above and that such detail need not be repeated.

The energetic material initiation device 10*a* can include a housing assembly 12*a*, an initiator assembly 14, an input charge 16, a sleeve 18, a first barrier structure 20*a*, a second barrier structure 22 and an output charge 24. The housing assembly 12*a* can include a base assembly 30*a* and a cover 32.

The base assembly 30*a* can include a housing 36*a* and a spacing member 42. The housing 36*a* can include a first housing portion 200 and a second housing portion 202. The first housing portion 200 can be formed of an appropriate material, such as 304 stainless, and can include an input end 46*a*, an output end 48*a*, the first barrier structure 20*a*, a first cavity 210, which can extend between the input end 46 and the first barrier structure 20*a*, and a second cavity 212 that can extend between the first barrier structure 20*a* and the output end 48*a*. The housing 36*a* can further include a threaded portion 56, a drive portion 58, a flange member 60, which is disposed between the threaded portion 56 and the drive portion 58, and a recess 62.

The second housing portion 202 can include an insert member 220, a plurality of seal members 40 and a plurality of electric contacts 38. The insert member 220 can be formed of an appropriate material, such as 304 stainless, and can include a plurality of seal apertures 52*a* that are configured to receive an associated one of the seal members 40 therein. The insert member 220 may be employed as a platform onto which the seal members 40, the electric contacts 38 and the initiator assembly 14 may be assembled to form a subassembly cartridge 230. The input charge 16 and sleeve 18 can be inserted into the first cavity 210, the subassembly cartridge 230 can be inserted into the first cavity 210 such that the initiator assembly 14 abuts one or both of the input charge 16 and the sleeve 18, and the insert member 220 can be fixedly and sealingly coupled to the first housing portion 200. In the particular example provided, the insert member 220 is laser welded to the first housing portion 200 to form a hermetic seal therebetween.

The first barrier structure 20*a* can have a thickness of about 0.020 inch to about 0.080 inch and preferably about 0.040 inch to about 0.060 inch. As the first barrier structure 20*a* is unitarily formed with the first housing portion 200, it will be appreciated that it provides a hermetic seal between the input charge 16 and the output charge 24.

The second barrier structure 22 can be received in the second cavity 212 and can be disposed adjacent the first barrier structure 20*a*. The output charge 24 can be received in the second cavity 212 adjacent or proximate the second barrier structure 22. Optionally, a resilient member 136, such as a silicone rubber washer, can be disposed between the second barrier structure 22 and the output charge 24 and/or between the output charge 24 and the cover 32. The cover 32 can be fixedly and sealingly coupled to the first housing portion 200 in a manner that is similar to that which is described above.

Figure 14:
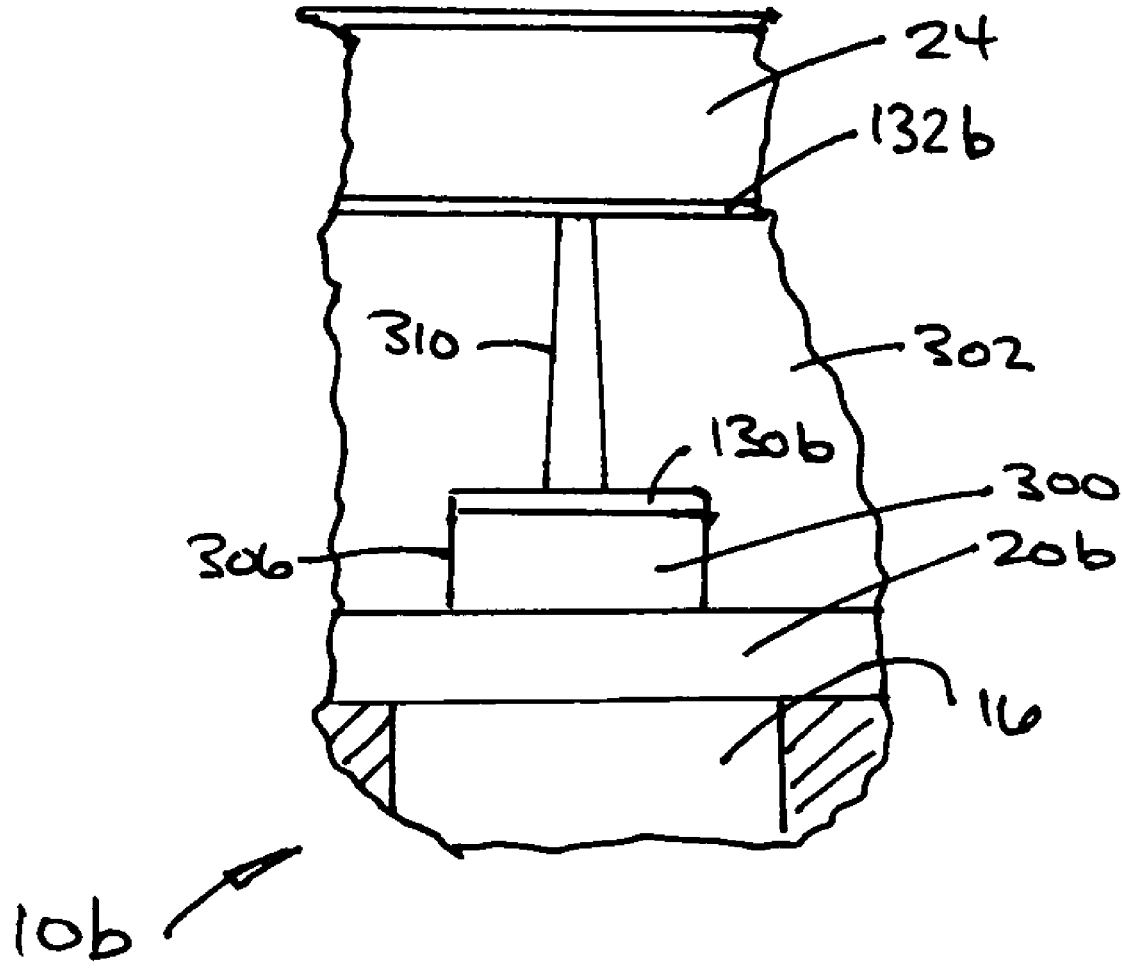
FIG. 14 is a partial section view taken along the longitudinal axis of yet another energetic material initiation device constructed in accordance with the teachings of the present disclosure.

A further energetic material initiation device 10*b* is partially illustrated in FIG. 14. The input charge 16 can be abutted against the first barrier structure 20*b*. The second barrier structure 22*b* can include a deformable member 300, a reactable member 130*b*, such as a titanium disk, a holding structure 302 and an oxidizer member 132*b*, such as a Teflon® disk. The deformable member 300 can be formed of a material, such as rubber and disposed against the first barrier structure 20*b*. The reactable member 130*b* can be disposed on a side of the deformable member 300 opposite the first barrier structure 20*b* and can be received with the deformable member 300 in an aperture 306 that is formed in the holding structure 302. The oxidizer member 132*b* can be disposed on a side of the holding structure 302 opposite the first barrier structure 20*b* such that the oxidizer member 132*b* and the reactable member 130*b* are axially spaced apart from one another. The holding structure 302 can include a barrel 310 that can have a tapered (i.e., conically shaped) wall. Optionally, the barrel 310 can have a straight wall. The output charge 24 can be abutted against the oxidizer member 132*b*.

When the energetic material initiation device activated (i.e., via an exploding foil initiator as explained above), the input charge 16 will detonate and cause the first barrier structure 20*b* to deform and rapidly compress the deformable member 300. Energy stored in and/or transmitted through the deformable member 300 rapidly shears a portion of the reactable member 130*b* (the portion that is disposed in-line with the barrel 310) and propelling the sheared portion through the barrel 310 so that it impacts the oxidizer member 132*b* to initiate a burning reaction that subsequently ignites the output charge 24. It will be appreciated that the shape of the barrel 310 can be configured to affect the ignition of the output charge 24. For example, if the barrel 310 were to have a straight wall configuration, the burning reaction obtained through the impact of the reactable member 130*b* with the oxidizer member 132*b* would tend to initiate combustion in the adjacent face of the output charge, causing the output charge 24 to burn in an axial manner (i.e., from one face to the opposite face). In contrast, if the barrel 310 were to have a tapered wall configuration, the burning reaction would be more narrowly focused and would tend to inject a shaft of burning materials into the output charge 24, causing the output charge 24 to burn in a more radial manner (i.e., radially outward from the center). It will be appreciated that the shape and size of the barrel 310 can be configured to obtain combustion in the output charge 24 in a desired manner.

Although the example of FIG. 14 has been illustrated and described as including a deformable member, it will be appreciated that a an intermediate charge of a secondary explosive, such as RSI-007, could be substituted for the deformable member. In this example, energy released when the input charge 16 detonates will cause the intermediate charge to detonate and propel the portion of the reactable member 130*b* through the barrel 310 to initiate a burning reaction with the oxidizer member 132*b* and ignite the output charge 24.

While the initiators have been illustrated as employing a cylinder-shaped input charge 16, it will be appreciated that the input charge 16 may be shaped in any desired manner. For example, the input charge 16 could be shaped (i.e., a shaped charge) to further facilitate the transfer of energy to the output charge 20, which could permit the first barrier member (20, 20*a*) to be relatively thicker. The shaped charge could have a case formed of a light metal, such as aluminum or titanium, and could be configured to inject a shaft of burning material through the output charge 24 in a manner that is similar to that which is provided by the barrel 310 in the example of FIG. 14.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

What is claimed is:

1. An igniter assembly comprising:

a housing;

an initator;

an input charge formed of a secondary explosive, the input charge being disposed adjacent the initiator;

a first barrier cooperating with the housing to form a chamber into which the input charge is received;

a second barrier disposed on a side of the first barrier opposite the input charge, the second barrier being combustible in response to energy released during detonation of the input charge; and an output charge formed of a pyrotechnic material, the output charge being disposed on a side of the second barrier opposite the first barrier and being combustible in response to energy released during combustion of the second barrier;

wherein the housing and the first barrier cooperate to form a structure that isolates the output charge from heat and pressure generated by the input charge if the input charge is cooked-off so that the output charge is not sympathetically cooked-off or initiated.

2. The igniter assembly of claim 1, further comprising a plurality of electric contacts and a plurality of seal members, each of the electric contacts extending through the housing and being electrically coupled to the initiator, each of the seal members sealingly engaging the housing and a respective one of the electric contacts.

3. The igniter assembly of claim 2, wherein the seal members are formed of a dielectric material.

4. The igniter assembly of claim 3, wherein the dielectric material is glass.

5. The igniter assembly of claim 2, wherein the seal members do not extend into the chamber.

6. The igniter assembly of claim 1, wherein the first barrier is integrally formed with the housing.

7. The igniter assembly of claim 1, wherein an aperture is formed in an end of the housing and wherein the first barrier structure is received into the aperture.

8. The igniter assembly of claim 7, wherein the first barrier structure is cup-shaped.

9. The igniter assembly of claim 1, wherein the initiator includes an exploding foil initiator.

10. The igniter assembly of claim 1, wherein the second barrier structure includes a holding structure, a reactable member and an oxidizer member, the holding structure defining a hole that is disposed in-line with the reactable member and the oxidizer member.

11. An igniter assembly comprising:

a housing;

a first barrier received in the housing and cooperating with the housing to form a chamber;

an input charge disposed in the chamber and formed of a secondary explosive;

a second barrier disposed on a side of the first barrier opposite the input charge; and an output charge formed of a pyrotechnic material and disposed on a side of the second barrier opposite the first barrier, the output charge being combustible in response to a chemical reaction that involves at least a portion of the second barrier and energy that is generated through detonation of the input charge, wherein combustion of the output charge produces a pyrotechnic output and wherein the first barrier and the housing cooperate to form a structure that prevents the output charge from being cooked-off or initiated in response to heat, pressure or both heat and pressure generated by the input charge if the input charge is electrically cooked-off.

12. The igniter assembly of claim 11, further comprising an initiator received in the chamber, the initiator being selectively operable for initiating a detonation event in the input charge.

13. The igniter assembly of claim 12, wherein the initiator includes an exploding foil initiator.

14. An igniter assembly comprising:

a housing;

a first barrier received in the housing and cooperating with the housing to form a chamber;

an input charge received in the chamber and formed of a secondary explosive and having a mass that is less than or equal to about 20 milligrams;

an initiator disposed in the housing adjacent the input charge, the initiator being selectively operable for initiating detonation of the input charge;

a second barrier disposed on a side of the first barrier opposite the input charge; and an output charge formed of a pyrotechnic material and disposed on a side of the second barrier opposite the first barrier, the output charge cooperating with the second barrier to cooperatively produce a pyrotechnic output in response to detonation of the input charge;

wherein the first barrier cooperates with the housing to form a structure that inhibits the output charge from being cooked-off or initiated in response to heat, pressure or both heat and pressure generated by the input charge if the input charge is electrically cooked-off.

15. The igniter assembly of claim 14, further comprising a plurality of electric contacts and a plurality of seal members, each of the electric contacts extending through the housing and being electrically coupled to the initiator, each of the seal members sealingly engaging the housing and a respective one of the electric contacts.

16. The igniter assembly of claim 15, wherein the seal members are formed of a dielectric material.

17. The igniter assembly of claim 16, wherein the dielectric material is glass.

18. The igniter assembly of claim 15, wherein the seal members do not extend into the chamber.

19. The igniter assembly of claim 14, wherein the first barrier is integrally formed with the housing.

20. The igniter assembly of claim 14, wherein an aperture is formed in an end of the housing and wherein the first barrier structure is received into the aperture.

21. The igniter assembly of claim 20, wherein the first barrier structure is cup-shaped.

22. The igniter assembly of claim 14, wherein the initiator includes an exploding foil initiator.

23. The igniter assembly of claim 14, wherein the second barrier structure includes a holding structure, a reactable member and an oxidizer member, the holding structure defining a hole that is disposed in-line with the reactable member and the oxidizer member.

24. An igniter assembly comprising:

a housing with an aperture formed in a first end of the housing;

a first barrier received in the aperture in the housing and cooperating with the housing to form a chamber, the first barrier being generally cup-shaped;

an input charge received in the chamber and formed of a secondary explosive and having a mass that is less than or equal to about 20 milligrams;

an initiator disposed in the housing adjacent the input charge, the initiator including an exploding foil initiator and being selectively operable for initiating detonation of the input charge;

a plurality of electric contacts extending through the housing and electrically coupled to the initiator;

a plurality of seal members formed of glass, each of the seal members sealingly engaging the housing and a respective one of the electric contacts but not extending into the chamber;

a second barrier disposed on a side of the first barrier opposite the input charge; and an output charge formed of a pyrotechnic material and disposed on a side of the second barrier opposite the first barrier, the output charge cooperating with the second barrier to cooperatively produce a pyrotechnic output in response to detonation of the input charge;

wherein the first barrier cooperates with the housing to form a structure that inhibits the output charge from being cooked-off or initiated in response to heat, pressure or both heat and pressure generated by the input charge if the input charge is electrically cooked-off.

* * * * *